United States Patent [19]

Frank

[11] Patent Number: 4,954,096

[45] Date of Patent: Sep. 4, 1990

[54] ELECTRICAL JACK WITH FIXED DETENT

[75] Inventor: John J. Frank, Chicago, Ill.

[73] Assignee: Switchcraft, Inc., Chicago, Ill.

[21] Appl. No.: 477,135

[22] Filed: Feb. 8, 1990

Related U.S. Application Data

[63] Continuation of Ser. No. 318,095, Mar. 2, 1989, abandoned.

[51] Int. Cl.[5] ..... H01R 4/50

[52] U.S. Cl. ..... 439/346; 439/668

[58] Field of Search ..... 439/282, 345, 346, 347, 439/668, 669, 586, 592, 593

[56] References Cited

U.S. PATENT DOCUMENTS

| | | | |
|---|---|---|---|
| 2,815,494 | 12/1957 | Hutchings | 439/593 |
| 3,885,850 | 5/1975 | Witte et al. | 439/346 |
| 4,436,359 | 3/1984 | Kasper et al. | 439/346 X |
| 4,659,167 | 4/1987 | Masuda | 439/668 |
| 4,770,639 | 9/1988 | Lau | 439/668 X |

FOREIGN PATENT DOCUMENTS

| | | | |
|---|---|---|---|
| 0241878 | 2/1961 | Australia | 439/593 |

*Primary Examiner*—Neil Abrams

*Assistant Examiner*—Khiem Nguyen

*Attorney, Agent, or Firm*—William R. Clark; Richard M. Sharkansky

[57] ABSTRACT

An electrical jack module having a dielectric box-like housing with an end wall integrally joined to a side wall of the housing, the end wall having extended through its thickness a plurality of mutually spaced sleeves which define respective plug receiving apertures. The side wall has projecting integrally from its inner surface within the housing a plurality of rigid ramp-like detents, each of which is fixedly aligned with a respective one of the plug receiving apertures. Each of the detents has a lower end portion with a sloped surface merging with the inner surface of the side wall adjacent the respective aligned aperture, and has an opposing higher end portion with a surface terminating in an edge portion of the detent aligned with a sheer end surface thereof. The edge portion of the detent is spaced a predetermined distance from the respectively aligned aperture for buttingly engaging a specific portion of a fully inserted jack plug and for restraining withdrawal of the jack plug from the fully inserted position independently of any resilient restraining force exerted by electrical contact members of the module.

13 Claims, 1 Drawing Sheet

ELECTRICAL JACK WITH FIXED DETENT

This application is a continuation of application Ser. No. 318,095 filed Mar. 2, 1989 now abandoned.

BACKGROUND OF THE INVENTION

1. Field of the Invention

This invention relates generally to electrical jacks and is concerned more particularly with an electrical jack having rigid means for retaining an electrical jack plug in a desired position within the electrical jack until intentionally withdrawn therefrom.

2. Discussion of the Prior Art

An electrical jack, such as a telephone jack, for example, generally comprises a stacked array of electrical switches having respective blade-like moveable members disposed for bendable movement relative to respective blade-like stationary members. The moveable members have respective cam-like portions aligned with a plug receiving sleeve for actuation of the switches by an electrical jack plug inserted axially through the sleeve. Electrically conductive portions of the jack plug are insulated from one another and are disposed for rubbing engagement with respective cam-like portions of the moveable members. As a result, the moveable members are forced to bend resiliently from their respective relaxed positions and relative to respective stationary members of the switches thereby effecting an alternate electrical relationship with the associated stationary members. Also, the moveable members may be electrically connected through respective engaged conductive portions of the jack plug to internally connected conductors for electrical connection to respective external electrical circuits.

Generally, it is expected that the electrical jack plug will be retained in the fully inserted position due to the spring action of the moveable members pressing their respective cam-like portions against the engaged conductive portions of the plug. However, it may be found that the cam-like portions of the moveable members do not exert sufficient resilient pressure to counteract an accidental or inadvertent pulling force applied to a patch cord attached to the jack plug. As a result, the electrical jack plug may be partly or totally withdrawn from the electrical jack thereby causing unintentional breaking of electrical connections and undesired interruptions in the external electrical circuits.

SUMMARY OF THE INVENTION

Accordingly, these and other disadvantages of the prior art are overcome by this invention providing an electrical jack with a housing having fixed therein rigid detent means for retaining an electrical jack plug in a fully inserted position in the electrical jack.

The electrical jack of this invention comprises a dielectric housing having an end wall provided with a plug receiving aperture which is aligned within the housing with a ramp-like detent protruding integrally from an adjacent supporting side wall of the housing. The ramp-like detent has an inclined surface extending from a low end portion of the detent adjacent the plug receiving aperture to an opposing higher end portion of the detent adjacent a sheer end surface thereof. The sheer end surface of the detent may be disposed substantially orthogonally to the surface of the supporting side wall or may be disposed at an acute angle thereto, as measured counterclockwise from the surface of the supporting side wall to the sheer end surface. Also, the inclined surface of the detent may have disposed therein an extension of a guide channel which is molded in the surface of the supporting side wall and communicates with the plug receiving aperture in the end wall of the housing.

Moreover, the housing has supported therein a coplanar array of blade-like resilient conductors which generally comprise the moveable contact members of respective electrical switches having respective stationary contact members disposed for electrical engagement with respective associated ones of the moveable contact members. The blade-like resilient conductors have respective cam-like portions disposed in alignment with the plug receiving aperture. Also, one of the cam-like portions is disposed adjacent the ramp-like detent, and may be aligned with the inclined surface thereof.

Thus, when an electrical jack plug is inserted fully through the plug receiving aperture, mutually insulated conductive portions of the plug are brought into rubbing contact relationship with respective cam-like portions of the moveable members. As a result, the moveable contact members are forced to move resiliently from their respective relaxed positons and relative to associated stationary members of the electrical switches. Simultaneously, a leading portion of the plug travels over the inclined surface of the ramp-like detent and one of the conductive portions of the plug snaps into locking engagement with the sheer end surface of the detent. The conductive portion of the plug thus secured to the ramp-like detent also is disposed in electrical engagement with the aligned cam-like portion of a moveable member. Consequently, the electrical jack plug is retained in the fully inserted position within the electrical jack housing while the conductive portions of the plug are disposed in electrically contacting relationship with the cam-like portions of respective moveable members.

BRIEF DESCRIPTION OF THE DRAWING

For a better understanding of the disclosed invention, reference is made in the following detailed description to the accompanying drawing wherein.

DESCRIPTION OF THE PREFERRED EMBODIMENT

Figure 2:
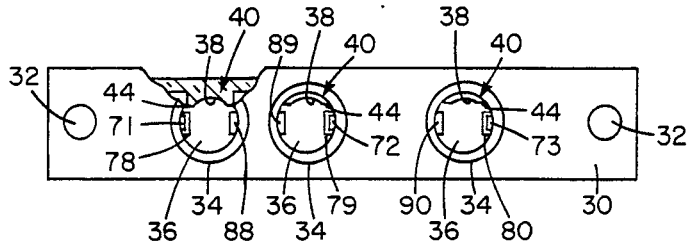
FIG. 2 is a plan end view, partly in section, of the module shown in FIG. 1.
Figure 1:
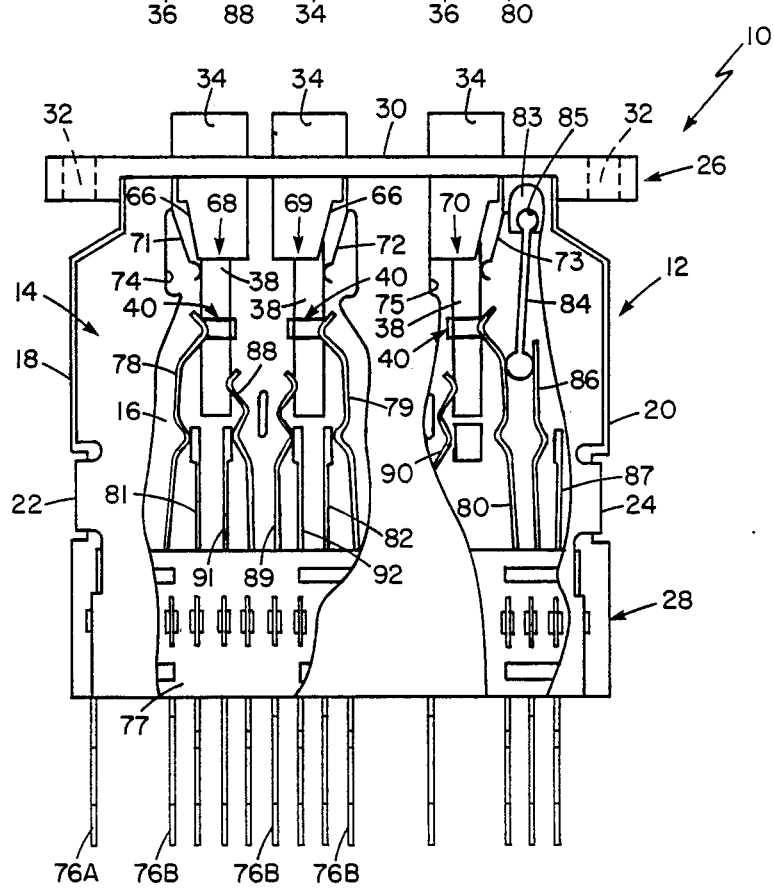
FIG. 1 is an elevational view, partly in section, of a tri-jack telephone module embodying the invention.

Referring to the drawing wherein like characters of reference designate like parts, FIGS. 1 and 2 show a tri-jack module 10 of the type described in U.S. Pat. No. 4,770,639 granted to Frederick L. Lau on Sept. 13, 1988 and assigned to the present assignee. Module 10 has a slab-like body comprising a shallow box-like enclosure or housing 12 having a broad open side substantially closed by a ground plane cover 14. The housing 12 is made of rigid dielectric material, such as molded plastic material, for example; and the ground plane cover is made of electric conductive resilient material, such as nickel alloy sheet material, for example.

Housing 12 has opposite its broad open side a similarly broad closed side comprising side wall 16 which has opposing edge portions integrally joined to relatively narrow side walls, 18 and 20, respectively, of the housing 12. The cover 14 is removably secured to respective side walls 18 and 20 by resilient means, such as respective tangs 22 and 24, for example, which engage the side walls 18 and 20 in a manner fully described in the aforesaid U.S. Pat. No. 4,770,639. The walls 16, 18 and 20 also are integrally joined to a plug receiving end portion 26 of housing 12 and to an opposing terminal mounting end portion 28 of housing 12. Thus, the opposing narrow side walls 18 and 20, respectively, and the opposing end portions 26 and 28, respectively, define the broad open side of housing 12.

The plug receiving end portion 26 of housing 12 comprises an elongated front plate 30 having respective mounting holes 32 in its opposing end portions which extend outwardly from the narrow side walls 18 and 20, respectively. A portion of the front plate 30 between the side walls 18 and 20 has protruding integrally from its outer surface a longitudinally aligned series of three mutually spaced sleeves 34 which define respective plug receiving apertures 36. The sleeves 34 extend integrally through the thickness of front plate 30 and terminate within housing 12 adjacent end portions of respective colinear grooves 38 which are disposed, as by molding, for example, in the inner surface of side wall 16. The grooves 38 comprise respective plug guiding channel means which are aligned with respective plug receiving apertures 36 defined by the colinear sleeves 34.

Each of the grooves 38 communicates with the aligned plug receiving aperture 36 and has a respective cross-sectional configuration, such as crescent shaped, for example, which conforms to an aligned portion of the communicating aperture 36. Accordingly, each of the grooves 38 has a substantially uniform depth and has a respective width dimension which is no greater than the largest width dimension, such as the diameter, for example, of the respective communicating aperture 36. The grooves 38 extend linearly from the respective communicating apertures 36 to respective aligned detents 40 which are spaced respective uniform distances from the respective colinear sleeves 34. The detents 40 have respective widths which extend transversely of the aligned grooves 38 and which are greater than the widths of the respective grooves 38.

Figure 3:
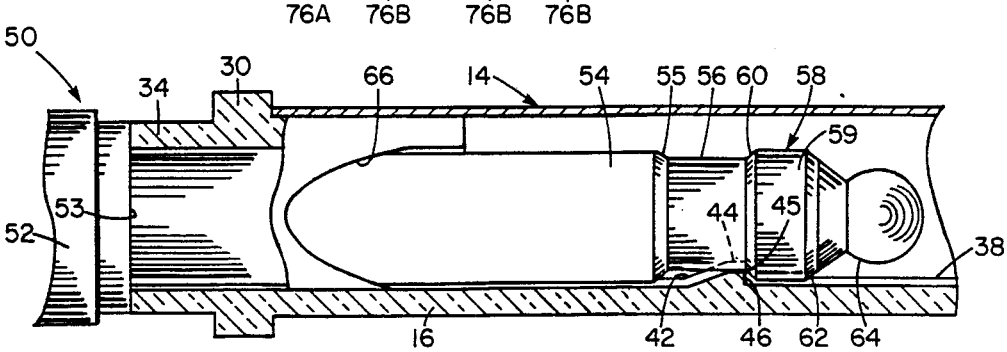
FIG. 3 is an enlarged fragmentary view, partly in section, of a telephone jack plug fully inserted through one of the plug receiving sleeves shown in FIG. 1.

As shown in FIG. 3, each of the detents 40 comprises a rigid ramp-like projection extending integrally from the inner surface of side wall 16 and having a sloped surface 42 fixed in alignment with a respective groove 38. The sloped surface 42 extends from a tapered end portion of a respective detent 40 adjacent the aligned aperture 36 to an opposing higher end portion of the detent 40 which may have a generally flat surface 44 disposed substantially parallel with the inner surface of side wall 16. The higher end portion of detent 40 terminates in a sheer end surface 46 thereof which is disposed at a predetermined fixed distance from the outer end of the respective sleeve 34 defining the aligned aperture 36. Each of the grooves 38 is disposed centrally in the sloped surface 42 of the aligned detent 40 and extends centrally into the generally flat surface 44 at the higher end portion of the respective detent 40. Also, the grooves 38 extend along the inner surface of side wall 16 from the respective sheer end surfaces 46 of aligned detents 40 to respective uniform distances therefrom.

In practice there may be inserted axially through any one of the sleeves 34 a conventional telephone type of electrical jack plug 50, which may terminate an electrical patch cord (not shown). Jack plug 50 generally comprises a cylindrical body having an electrically conductive portion encircled by a dielectric bushing 52 and forming an annular shoulder 53 adjacent an attached end of an elongated sleeve member 54 of plug 50. The annular shoulder 53 functions as a positive stop means for limiting axial insertion of the plug 50 into a plug receiving aperture, such as 36, for example.

Sleeve member 54 is made of electrically conductive material and has a substantially uniform diameter which is only slightly less than the diameters of the respective plug receiving apertures 36. The opposing end of sleeve member 54 is insulatingly attached through a dielectric annulus 55 having a bevelled outer periphery to a reduced diameter portion 56 of an electrically conductive ring member 58 of plug 50. The reduced diameter portion 56 is integrally joined to a larger diameter portion 59 of ring member 58 through an interposed portion thereof having an outer periphery forming an outwardly bevelled shoulder 60. Shoulder 60 is disposed at a predetermined linear distance from the annular shoulder 53. The larger diameter portion 59 of ring member 58 is insulatingly attached through a dielectric annulus 62 having a bevelled outer periphery to a frusto-conical portion of an electrically conductive tip member 64 of plug 50. The frusto-conical portion has an opposing smaller diameter end integrally joined to a generally spherical portion of tip member 64 which constitutes the distal end portion of plug 50.

Thus, when the jack plug 50 is inserted into the aperture 36 defined by a selected sleeve 34, an axially directed pushing force exerted on the cylindrical body of plug 50 causes it to slide longitudinally along the communicating groove 38 in housing 12. As a result, the spherical end portion of tip member 64 passes unimpeded over the higher end portion of the aligned ramp-like detent 40; and the bevelled outer periphery of dielectric annulus 62 slidingly engages the portion of groove 38 in sloped surface 42 of detent 40. Consequently, the cylindrical body of plug 50 is directed up the sloped surface 42 to the higher end portion of detent 40 where the large diameter portion 59 of ring member 58 slidingly engages the portion of groove 38 in the generally flat surface 44 of detent 40. At this instant, the cylindrical body of plug 50 is supported relative to the inner surface of side wall 16 at a slight angle which is maintained through the length of the selected sleeve 34.

Conveniently, the selected sleeve 34 is provided with flexible wall means for yielding resiliently in permitting the angular disposition of plug 50 relative to the axial centerline of the respective aperture 36 while maintaining a resilient opposing pressure on the angular disposed plug 50. The flexible wall means may be provided by disposing in the inner end portion of the respective sleeves 34 one or more longitudinally extending openings, such as 66, for example, having closed ends adjacent the front plate 30. The opening 66 is disposed in a plane extending at an angle to the axial centerline of the respective sleeves 34 and has a generally parabolic configuration with an open end at the inner end of the respective sleeves 34. Thus, when the cylindrical body of plug 50 is disposed at a slight angle to the inner end surface of side wall 16, the sleeve member 54 of plug 50 exerts a pressure against the wall portion of sleeve 34 adjacent the cover 14. As a result, the wall portion of sleeves 38 adjacent cover 14 flexes a corresponding slight amount while maintaining a resilient opposing pressure on the cylindrical body of plug 50. As an alternative to disposing longitudinal cuts in the respective inner end portions of the sleeves 34, the entire lengths of sleeves 34 or the respective inner end portions of sleeves 34 may be made of flexible material, such as the class of polysneric amides with recurring amide groups, for example.

Continuation of the axially directed pushing force exerted on the cylindrical body of plug 50 causes the annular shoulder 53 thereof to be brought into butting relationship with the outer end of the selected sleeve 34 thereby preventing further insertion of the plug 50. Simultaneously, the large diameter portion 59 of ring member 58 is pushed off the sheer end of detent 40 and, due to the resilient pressure exerted by the flexible wall means of the selected sleeve 34, snaps into the portion of groove 38 adjacent the base of sheer end surface 46. In doing so, the large diameter portion 59 generally produces an audible "click" sound which serves as an indication that the cylindrical body of plug 50 is properly disposed in the fully inserted position within housing 12. Moreover, the bevelled shoulder 60 of ring member 58 is disposed adjacent the sheer end surface 46 of detent 40 whereby an axially directed pulling force exerted on plug 50 brings the bevelled shoulder 60 into butting relationship with the sheer end surface 46 of detent 40. Thus, the outer end of the selected sleeve 34 and the sheer end surface 46 of detent 40 are rigidly disposed between the annular shoulder 53 of plug 50 and the bevelled shoulder 60 of ring member 58 for retaining the plug 50 in a desired position within housing 12.

Figure 5:
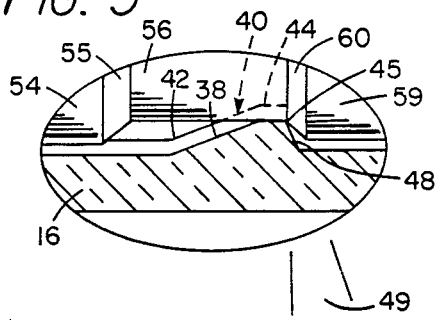
FIG. 5 is an enlarged fragmentary view of an alternative embodiment of the ramp-like detent shown in FIG. 4.
Figure 4:
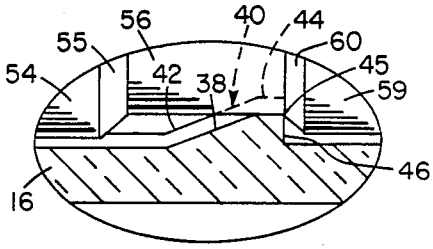
FIG. 4 is an enlarged fragmentary view of the ramp-like detent shown in FIG. 3.

An axially directed pulling force exerted on plug 50, as shown more clearly in FIG. 4, draws the bevelled shoulder 60 of ring member 58 against an edge portion 45 of detent 40. The edge portion 45 is formed where the portion of groove 38 in the generally flat surface 44 of detent 40 terminates at the sheer end surface 46 thereof. Edge portion 45 provides a minimal bearing surface and, consequently, a high frictional resistance when attempting to slide the bevelled shoulder 60 up onto the higher end portion of detent 40. Accordingly, an accidental or inadvertent pulling force applied to plug 50 generally is not strong enough to overcome the frictional resistance produced by the edge portion 45 against the bevelled shoulder 60. In order to withdraw the plug 50 from its fully inserted position, it is necessary to increase the magnitude of the pulling force steadily until it is greater than the frictional resistance offered by the edge portion 45. Then, the bevelled shoulder 60 slides up the edge portion 45 to a position where the large diameter portion 59 of ring member 58 again slidingly engages the portion of groove 38 in the generally flat surface 44 of detent 40. If the frictional resistance offered by the edge portion 45 is deemed excessive, it may be decreased by increasing the bearing surface of edge position 45, as by rounding the edge portion 45, for example. As another alternative, the bearing surface of edge portion 45 may be increased, as shown in FIG. 5, by providing the detent 40 with a chamfered end surface 48 which is disposed at an acute angle 49, measured from the normal to the inner surface of side wall 16 and counterclockwise to the chamfered end surface 48.

Referring again to FIGS. 1 and 2, the remaining features of the tri-jack module 10 are related to structural members which are more fully disclosed in the aforesaid U.S. Pat. No. 4,770,639. There is disposed in housing 12 a planar array of electrical jacks 68, 69 and 70, respectively, each of which is aligned with a respective sleeve 34 defining a plugreceiving aperture 36. Accordingly, when the slab-like body of module 10 is oriented with one of its narrow side walls 18 and 20 uppermost, the electrical jacks 68, 69 and 70 comprise a vertically stacked array of mutually spaced electrical jacks.

The electrical jacks 68, 69 and 70 include respective sleeve actuated contact members 71, 72 and 73 which are resiliently yieldable blade-like members extending integrally from respective portions of the metallic cover 14 adjacent openings 36 in the respective sleeves 34. Sleeve actuated contact members 71, 72 and 73 have respective curved distal end portions which are disposed adjacent inner ends of respective apertures 36 and overlie side portions of the respective communicating grooves 38. Thus, the distal end portions of sleeve actuated contact members 71, 72 and 73 comprise respective cam portions thereof which are disposed for resiliently pressured, rubbing engagement and contacting electrical relationship with the sleeve members 54 of respective plugs 50 inserted through the apertures 36. However, it should be noted that the distal end portions of the sleeve actuated contact members 71, 72 and 73 when pressing resiliently against the uniform diameters of the respective sleeve members 54 are not very effective in resisting accidental or inadvertent withdrawal of the plugs from the respective sleeves 34.

This electrical contacting operation of the sleeve actuated contact members 71, 72 and 73 may be observed through generally rectangular windows, 74 and 75, respectively, which are disposed in the cover 14 adjacent the front plate 30. Also, the ground plane cover 14 extends to the terminal mounting end portion 28 of housing 12 and has projecting outwardly therefrom an integral terminal portion 76A whereby the sleeve contacts 71, 72 and 73, respectively, are connected to electrical ground. The terminal portion 76A of cover 14 is disposed in a linear array of coextensive terminal portions 76B which extend integrally from respective ribbon-like contact members disposed edgewise in respective grooves (not shown) in the terminal mounting end portion 28 of housing 12. These ribbon-like contacts are maintained edgewise in their respective grooves by a dielectric retainer bracket 77 which underlies the cover 14 and is resiliently latched in place on the terminal mounting end portion of housing 12.

Electrical jacks 68, 69 and 70 within housing 12 also include ring actuated contact members 78, 79 and 80, respectively, which are made of ribbon-like, electrically conductive material. The ring actuated contact members 78, 79 and 80 are resiliently bendable and extend from the terminal mounting end portion 28 of housing 12 toward the plug receiving end portion 26 thereof. Ring actuated contact members 78 and 79 have respective rippled portions disposed in electrically contacting relationship with distal end portions of relatively stationary contact members 81 and 82, respectively, which extend from the terminal mounting end portion 28 of housing 12. The relatively stationary contact members 81 and 82 are made of ribbon-like, electrically conductive material and form, in conjunction with the respective ring actuated contact members 78 and 79, respective normally closed, electrical switches. Ring actuated contact member 80 has a rippled portion which optionally is not disposed in electrically operative relationship with a relatively stationary contact member.

The ring actuated contact members 78, 79 and 80 have respective curved distal end portions which are disposed in alignment with respective plug receiving apertures 36 and overlie side portions of respective ramp-like detents 40. Thus, the distal end portions of ring actuated contact members 78, 79 and 80 comprise respective cam-like portions thereof which are disposed for resiliently pressured, rubbing engagement and contacting electrical relationship with the ring members 58 of respective plugs 50. When the plugs 50 are fully inserted into the respective sleeves 34, the curved distal end portions of the contact members 78, 79 and 89 are disposed where the respective bevelled shoulders 60 of the plugs 50 are integrally joined to the respective reduced diameter portions 56 of the ring members 58. As a result, the ring actuated contact members 78, 79 and 80 are positioned to bear resiliently against the respective bevelled shoulders 60 in resisting accidental or inadvertent withdrawal of the respective plugs 50 from the sleeves 34. In pressing resiliently against the ring members 58 of respective plugs 50, the ring actuated contact members 78 and 79 are moved out of electrically contacting relationship with the relatively stationary contact members 81 and 82, respectively, thereby opening the respective electrical switches. Accordingly, it should be noted that the previously described positions and operations of the respective detents 40 do not interfere with the operations of the ring actuated contact members 78 and 79, respectively.

Housing 12 also may have molded therein adjacent the sleeve 34 aligned with electrical jack 80 a mesa-like portion 83 which is integrally joined to the front plate 30 and to the side wall 16. The mesa-like portion 83 has disposed therein a hinge socket 85 which slidable receives a cylindrical end portion of a barbell-like lifter 84 made of dielectric material. Lifter 84 has an opposing cylindrical end portion of relatively larger diameter which is disposed between the ring actuated contact member 80 and a distal end portion of a ribbon-like moveable switch member 86 made of electrically conductive material. The moveable switch member 86 bends resiliently and extends from the terminal mounting end portion 28 of housing 12.

Moveable switch member 86 has a rippled portion disposed in normally open or spaced relationship with a relatively stationary switch member 87 which is made of electrically conductive material and extends from the terminal mounting end portion 28 of housing 12. Thus, when the distal end portion of ring actuated contact member 80 electrically contacts the ring member 58 of the inserted plug 50, the ring actuated member 80 presses laterally against the larger diameter end of lifter 84 thereby causing it to swing arcuately about its smaller diameter end which pivots in the hinge socket 85. Consequently, the larger diameter end of lifter 84 insulatingly presses the moveable switch member 86 into electrical engagement with the relatively stationary switch member 87. Accordingly, it should be noted that the previously described operation of the detent 40 underlying the curved distal end portion of the ring actuated contact member 80 does not interfere with the operation of the ring actuated contact member 80.

The electrical jacks 68, 69 and 70 also include tip actuated contact members 88, 89 and 90, respectively, which are made of ribbon-like electrically conductive material. The tip actuated contact members 88, 89 and 90 are resiliently bendable and extend from the terminal mounting end portion 28 of housing 12. Tip actuated contact members 88 and 89 have respective rippled portions disposed in electrically contacting relationship with distal end portions of relatively stationary contact members 91 and 92, respectively, which extend from the terminal mounting end portion 28 of housing 12. The relatively stationary contact members 91 and 92 are made of ribbon-like, electrically conductive material and form, in conjunction with the respective tip actuated contact members 88 and 89, respective normally closed, electrical switches. Tip actuated member 90 has a rippled portion which optionally is not disposed in electrically operative realtionship with a relatively stationary contact member.

The tip actuated contact members 88, 89 and 90 have respective curved distal end portions which are disposed in alignment with respective plug apertures 36 and overlie side portions of the respective communicating grooves 38. Thus, the distal end portions of tip actuated contact members 88, 89 and 90 comprise respective cam-like portion which are disposed for resiliently pressured, rubbing engagement and contacting electrical relationship wtih the tip members 64 of respective plugs 50. When the plugs 50 are fully inserted into the respective sleeves 34 the curved distal end portions of the contact members 88, 89 and 90 are disposed where the frusto-conical portions of the tip members 64 are integrally joined to the respective spherical end portions thereof. As a result, the tip actuated contact members 88, 89 and 90 are positioned to bear resiliently against the respective spherical end portions of the tip members 64 in resisting accidental or inadvertent withdrawal of the respective plugs 50 from the sleeves 34. In pressing resiliently against the tip members 64 of respective plugs 50, the tip actuated contact members 88 and 89 are moved out of electrically contacting relationship with the relatively stationary contact members 91 and 92, respectively, thereby opening the respective electrical switches.

Thus, it may be seen that the electrical jacks 68, 79 and 70 are provided with respective primary retaining means which require the cooperation of respective ring actuated contact members 78, 79 and 80 with respective tip actuated contact members 88, 89 and 90 for resiliently resisting withdrawal of the respective plug 50 from the aligned sleeves 34. However, the resilient pressures exerted by these primary retaining means on the respective plugs 50 may not be sufficiently strong to withstand withdrawal pulling forces applied accidentally or inadvertently to the respective plugs 50. Therefore, each of the electrical jacks 68, 69 and 70 is provided with a respective secondary retaining means comprising a ramp-like detent 40 fixed into position relative to the respective plug receiving aperture 36 for rigidly resisting withdrawal of the respective plug 50 from its fully inserted position. Each of the detents 40 has a junction edge portion 45 integrally joining a sloped surface 42 to a sheer end surface 46 of the detent 40 and spaced a predetermined distance from one end of the aligned plug receiving aperture 36. Consequently, when a pulling withdrawal force is exerted on a fully inserted plug 50, a bevelled shoulder 60 thereof is brought into butting relationship with the edge portion 45 of the respective detent 40. As a result, withdrawal of the fully inserted plug 50 requires that pulling force be deliberately applied thereto and increased steadily until sufficient to draw the bevelled shoulder 60 up onto the highest portion of the ramp-like detent 40. Thus, it may be seen that the edge portion 45 of detent 40 functions as a restrictive means for restraining withdrawal of the jack plug 50 from the housing 12 until a deliberately strong pulling force is applied to the plug 50.

From the foregoing, it will be apparent that all of the objectives have been achieved by the structures and methods described herein. It also will be apparent, however, that various changes may be made by those skilled in the art without departing from the spirit of the inventive subject matter, as expressed in the appended claims. It is to be understood, therefore, that all matter shown and described is to be interpreted as illustrative and not in a limiting sense.

What is claimed is:

1. An electrical jack housing comprising:

a dielectric box-like enclosure having an end wall provided with aperture means for permitting an electrical jack plug to be inserted through said end wall and along a predetermined path in said enclosure, said aperture means including an aperture extended axially through the thickness of said end wall and communicating with the interior of said enclosure, said aperture being surrounded by a sleeve with flexible wall means for yielding resiliently to permit angular disposition of said plug in said sleeve relative to the axial centerline of said aperture; and said enclosure having side wall means disposed substantially orthogonal to said end wall and extended along said predetermined path for supporting fixedly in said path rigid retaining means, said retaining means being disposed for releaseably engaging a portion of said jack plug and rigidly resisting withdrawal of said jack plug from said enclosure, said side wall means including a side wall of said enclosure having an inner surface portion disposed in alignment with said aperture, said side wall comprising a guide channel extending along said predetermined path, said retaining means comprising a rigid projection having a sloped surface extending integrally from said side wall in said channel wherein, during insertion of said plug in said guide channel along said predetermined path, said plug slides up said sloped surface of said rigid projection to an angle with respect to said axial centerline of said aperture and said side wall, said sleeve resiliently yielding and maintaining resiliently opposing pressure on said plug.

2. An electrical jack housing as set forth in claim 1 wherein said rigid projection comprises a ramp-like detent projected integrally from said inner surface portion of said side wall and into alignment with said aperture, said ramp-like detent having a sloped end portion merging with said inner surface portion of said side wall adjacent said aperture and having an opposing higher end portion terminating in a sheer end surface of said detent.

3. An electrical jack as set forth in claim 2 wherein said sheer end surface of said detent is disposed at an acute angle as measured from said inner surface portion of said side wall counterclockwise to said sheer end surface.

4. An electrical jack housing as set forth in claim 3 wherein said guide channel comprises a linear groove disposed in said inner surface portion of said side wall and extended up onto said sloped end portion of said detent.

5. An electrical jack module comprising:

a dielectric box-like housing having an end wall integrally joined to a side wall of said housing, said end wall having extended through its thickness aperture means for inserting an electrical jack plug having a reduced diameter portion with a shoulder through said end wall and into said housing;

said side wall being flexible and having inner surface means disposed in said housing for slidably engaging said jack plug, said inner surface means including rigid retaining means fixedly disposed in alignment with said aperture means for releaseably contacting and securing said shoulder of said jack plug when said jack plug is fully inserted in said housing and for rigidly resisting withdrawal of said jack plug from said housing; and electrical conductor means supported in said housing for actuation in response to insertion of said jack plug into said housing through said aperture means, said electrical conductor means including cam-like means resiliently positioned in alignment with said aperture means for resiliently contacting said shoulder of said jack plug when said jack plug is fully inserted in said housing and for resiliently resisting withdrawal of said jack plug from said housing.

6. An electrical jack plug module as set forth in claim 5 wherein said aperture means includes a plurality of mutually spaced apertures extended axially through said end wall, and said rigid retaining means includes a plurality of ramp-like detents equal in number to said plurality of apertures, each of said detents being integrally projected from said side wall and into fixed alignment with a respective one of said apertures.

7. An electrical jack module as set forth in claim 6 wherein each of said ramp-like detents has an end portion with a sloped surface merging with said side wall adjacent said aligned aperture and has an opposing end portion with a surface terminating at an edge portion of said detent, said edge portion being aligned with a sheer end surface of said detent.

8. An electrical jack module as set forth in claim 7 wherein said edge portion of said detent is spaced a predetermined distance from said aligned aperture and comprises restricting means for buttingly engaging a specific portion of said jack plug and restraining withdrawal of said plug from a fully inserted position in said housing.

9. An electrical jack module as set forth in claim 8 wherein said inner surface means of said side wall includes a plurality of channel means equal in number to said plurality of apertures, each of said channel means comprising a linear groove disposed in said wall in communication with a respective aperture and extending therefrom up onto said sloped surface of said aligned detent for slidably directing said jack plug from said respective aperture to said aligned detent.

10. An electrical jack module as set forth in claim 8 wherein said aperture means includes a plurality of sleeves equal in number to said plurality of apertures, each of said sleeves being extended axially through said end wall and defining a respective one of said apertures.

11. An electrical jack module as set forth in claim 9 wherein each of said sleeves is provided with respective flexible wall means for permitting said jack plug to be disposed at an acute angle to the axial centerline of said respective aperture.

12. An electrical jack module as set forth in claim 8 wherein said electrical conductor means includes a plurality of ribbon-like conductors equal in number to said plurality of apertures and supported for resilient bendable movement relative thereto, each of said ribbon-like conductors having respective cam-like means comprising a curved portion thereof resiliently positioned in alignment with a respective one of said apertures for resilient pressure engagement with jack plug.

13. An electrical jack module as set forth in claim 12 wherein each of said ribbon-like conductors has its curved portion resiliently positioned over said aligned detent for resilient pressure engagement with said specific portion of said jack plug independently of said edge portion of said detent and for resiliently restraining withdrawal of said jack plug from said housing.

* * * * *